US006662547B2

(12) United States Patent
Mandai et al.

(10) Patent No.: US 6,662,547 B2
(45) Date of Patent: Dec. 16, 2003

(54) COMBUSTOR

(75) Inventors: Shigemi Mandai, Takasago (JP); Masataka Ohta, Takasago (JP); Satoshi Tanimura, Takasago (JP); Katsunori Tanaka, Takasago (JP); Koichi Nishida, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 6 days.

(21) Appl. No.: 09/987,519

(22) Filed: Nov. 15, 2001

(65) Prior Publication Data

US 2002/0061485 A1 May 23, 2002

(30) Foreign Application Priority Data

Nov. 17, 2000 (JP) ..... 2000-351027

(51) Int. Cl.[7] ..... F02C 3/30
(52) U.S. Cl. ..... 60/39.55; 239/424
(58) Field of Search ..... 60/39.55, 39.58, 60/39.59; 239/418, 423, 424

(56) References Cited

U.S. PATENT DOCUMENTS

| | | | | | |
|---|---|---|---|---|---|
| 2,168,313 | A | * | 8/1939 | Bichowsky | 60/39.55 |
| 2,453,378 | A | * | 11/1948 | Lubbock | 60/39.55 |
| 3,747,336 | A | * | 7/1973 | Dibelius et al. | 60/39.55 |
| 4,425,755 | A | | 1/1984 | Hughes | |
| 4,533,314 | A | * | 8/1985 | Herberling | 60/39.55 |
| 5,009,070 | A | * | 4/1991 | Iizuka et al. | 60/39.55 |
| 5,224,851 | A | | 7/1993 | Johnson | |
| 5,408,830 | A | | 4/1995 | Lovett | |
| 5,690,039 | A | | 11/1997 | Monro et al. | |
| 6,349,536 | B1 | * | 2/2002 | Fujioka | 60/39.55 |

FOREIGN PATENT DOCUMENTS

| | | | | |
|---|---|---|---|---|
| EP | 0 314 112 | | 5/1989 | |
| GB | 644 719 | | 10/1950 | |
| JP | 52-39007 | * | 3/1977 | 60/39.55 |
| JP | 59-203826 | | 11/1984 | |
| JP | 6-66156 | * | 3/1994 | 60/39.55 |

* cited by examiner

*Primary Examiner*—Michael Koczo
(74) *Attorney, Agent, or Firm*—Oblon, Spivak, McClelland, Maier & Neustadt, P.C.

(57) ABSTRACT

A combustor includes a burner and a combustion chamber including a heat chamber to which fuel is supplied from the burner. The burner includes a nozzle having a fuel discharge outlet from which the fuel is discharged into the combustion chamber; and the nozzle includes a plurality of discharge openings around the fuel discharge outlet from which cooling water is discharged toward inside surfaces of the heat chamber. The plurality of discharge openings may be disposed so that the directions of the cooling water discharged from the discharge openings differ in the radial direction.

3 Claims, 5 Drawing Sheets

COMBUSTOR

BACKGROUND OF THE INVENTION

1. Field of the Invention

The present invention relates to a combustor. More specifically, the present invention relates to a combustor, such as a gas turbine combustor, which transfers a combustion gas from a burner to a combustion chamber and actuates a turbine by using the combustion gas.

2. Description of Related Art

In general, a gas turbine includes a compressor, a combustor, and a turbine as its main constituents, and the compressor and the turbine are directly connected to each other by a main shaft. The combustor is connected to a discharge opening of the compressor, and a working fluid discharged from the compressor is heated to predetermined turbine inlet temperature by the combustor. The working fluid of high temperature and high pressure supplied to the turbine passes between a stationary blade and a moving blade, which is attached to the main shaft side, and expands. In this manner, the main shaft is rotated and an output is obtained. For the case where a gas turbine is used, since a brake power from which power consumed by a compressor is subtracted is obtained, it may be used as a good driving source by connecting a generator, etc., to the other end of the main shaft.

A schematic structure of a gas turbine combustor will be explained as follows by using an oil firing combustor as an example.

In FIG. 10, the numeral 10 indicates an oil firing combustor. In the combustor 10, a premix nozzle 12 is provided along the central axis of a heat chamber 11. A pilot burner 13 is disposed at the center portion of the premix nozzle 12, and a plurality of main burners 1 are disposed with an equal interval between each other so as to surround the pilot burner 13. Accordingly, the central axis of the pilot burner 13 coincides with the central axis of the heat chamber 11.

Fuel is supplied to the pilot burner 13 via a pilot fuel pipe 14, and a pilot fuel discharged from a pilot fuel nozzle 14*a*, which is disposed at an end portion of the pilot burner 13, is combusted in a combustion chamber 10*a* in the heat chamber 11 using a swirling air flow as combusible air. The flame of the pilot burner 13 thus generated is used as an ignition source for a main burner 1 which will be described below.

Each of the main burners 1 for the premix nozzle 12 includes a main fuel supply duct 2, which is connected to a fuel supply source not shown in the figure, and a main swirler 5, which swirls an air flow passing through an outer periphery portion of the main fuel supply duct 2.

The main burner 1 discharges the fuel, which is introduced via the main fuel supply duct 2, from a fuel discharge outlet so that a premixed gas may be produced by premixing the fuel with the air flow. The premixed gas is discharged from each of the main burners 1 and flows around the pilot burner 13 as a swirling flow. The premixed gas is ignited by the above-mentioned flame of the pilot burner 13 used as the flaming source.

Also, the heat chamber 11, which forms the combustion chamber 10*a* of the combustor 10, has a structure in which a plurality of rings 15 are coupled, each of the rings 15 being formed by plate fins having a passage for introducing air at the outer periphery side into the inside along the inner surface as cooling air. A combustion process is carried out in the combustion chamber 10*a*, which is formed by the plurality of rings 15, and the generated combustion gas is transferred to a downstream side as a swirling flow to actuates a turbine, etc.

In the figure, the rings 15 forming the heat chamber 11 includes a first ring 15*a*, a second ring 15*b*, and a third ring 15*c* in order from the premix nozzle 12.

In the gas turbine having the above-mentioned combustor 10, when the output thereof is increased, an amount of the fuel supplied is also increased. In such a case, the temperature of the combustion chamber 10*a* is also increased due to the combustion of the larger amount of the fuel. For this reason, spraying a cooling water into the combustion chamber 10*a* is conventionally carried out in accordance with the amount of fuel supplied in order to control the temperature of the combustion gas, which is transferred to the turbine located at the downstream side, and increase the output thereof.

That is, the output of a gas turbine is determined by the turbine inlet temperature and the amount of gas supplied. Thus, when an output larger than possible at the temperature at that time is required, for instance, in summer, the amount of fuel supplied is increased. However, since the allowable temperature for a combustor or a turbine is already determined, the turbine inlet temperature is decreased to a design temperature by supplying water or water vapor into the air. In other words, the temperature of a combustion gas is decreased by increasing an amount of gas by water or water vapor injection so as to maintain a constant temperature, and the output is increased by supplying a large amount of fuel.

As mentioned above, although in the above-mentioned combustor 10, the temperature of the combustion gas transferred to the turbine is controlled by introducing the cooling water into the combustion chamber 10*a* in order to increase the output of the turbine, the temperature of the rings 15 forming the heat chamber 11 becomes high, particularly in case of an oil firing combustor, due to, for instance, the difference in the vaporizing rate between the fuel and the cooling water.

That is, for instance, in a low $NO_x$ combustor for a 1400° C.-level gas turbine, the ratio of air used for combustion is high in order to decrease a main flame temperature to achieve a low $NO_x$ level. For this reason, it is necessary to cool down the surfaces thereof using a very small amount of air, for instance, only about 3.5%. Although the temperature of the surfaces may be decreased to an allowable temperature using such a low amount of cooling air if a gaseous fuel is used, the temperature of the surfaces is increased when the load of the gas turbine exceeds a certain level, if a liquid fuel is used due to an insufficient uniformity between the air and the fuel, a high radiation, etc., and the life of the turbine is shortened. This is because when a liquid fuel is used, a mixing state of the fuel which is the same level as that of a liquid fuel cannot be obtained because of its large density which increases penetration and the wide range of particle size distribution when sprayed.

Accordingly, it is insufficient to carry out a cooling process using only a film cooling or a convection cooling, and there is a danger that the temperature will be drastically increased, particularly for the second ring 15*b* and the third ring 15*c* forming the downstream section of the heat chamber 11.

SUMMARY OF THE INVENTION

The present invention takes into consideration the above-mentioned circumstances, and has as an object providing a combustor which is capable of preventing heat from damaging a heat chamber of a combustor while enabling to increase an output thereof.

In order to achieve the above object, the present invention provides a combustor, including: a burner; and a combustion chamber including a heat chamber to which fuel is supplied from the burner, wherein the burner includes a nozzle having a fuel discharge outlet from which the fuel is discharged into the combustion chamber; and the nozzle includes a plurality of discharge openings around the fuel discharge outlet, from which cooling water is discharged toward inside surfaces of the heat chamber.

In accordance with another aspect of the invention, the fuel discharge outlet is formed at the center of the nozzle.

According to the above combustor, since the cooling water is discharged from the discharge openings disposed around the fuel discharge outlet which is formed at the center of the nozzle and the cooling water is sprayed onto the inside surfaces of the heat chamber, it becomes possible to reliably cool down the heat chamber.

For this reason, the heat damaging the heat chamber due to an increase in the combustion temperature may be reliably prevented even if an amount of fuel supplied is increased in order to increase the output of a turbine. Accordingly, this technique is suitable applied to an oil firing combustor whose temperature at the downstream side of the heat chamber is easily increased if cooling water is simply sprayed into the combustion chamber due the difference in the vaporization rate between the fuel and the cooling water.

In yet another aspect of the invention, the plurality of discharge openings are disposed so that the directions of the cooling water discharged from the discharge openings differ in the radial direction.

According to the above combustor, since the directions of the cooling water discharged from the discharge openings differ in the radial direction, the cooling water may be directed to various places in the axial direction of the inside surfaces of the heat chamber. Accordingly, it becomes possible to thoroughly cool down the heat chamber.

In yet another aspect of the invention, the plurality of discharge openings comprises an outer circumferential discharge opening which is formed toward the peripheral portion of the nozzle, a central discharge opening which is formed along the axial direction of the nozzle, and an inner circumferential discharge opening which is formed toward the center of the nozzle.

According to the above combustor, since the discharge openings include the outer circumferential discharge openings which are formed toward the peripheral portion of the nozzle, the central discharge openings which are formed along the axial direction of the nozzle, and the inner circumferential discharge openings which are formed toward the inside of the nozzle, the cooling water discharged from the outer circumferential discharge opening is not affected by the fuel discharged from the discharge outlet at the center of the nozzle of the burner and reaches positions at the inside of the combustion chamber further away from the burner, the cooling water discharged from the central discharge opening is more or less affected by the fuel discharged from the discharge outlet and the course of the cooling water is curved toward the periphery of the nozzle so that the cooling water reaches positions at the inside of the combustion chamber closer to the burner, and the cooling water discharged from the inner circumferential discharge opening is most affected by the fuel discharged from the discharge outlet and reaches positions at the inside of the combustion chamber closest to the burner. Accordingly, it becomes possible to thoroughly spray the cooling water, which is discharged from the discharge openings, onto the inside surfaces of the heat chamber so that the heat damaging the heat chamber by heat may be reliably prevented.

In yet another aspect of the invention, the directions of the cooling water discharged from the discharge openings differ by using swirling angles of the discharge openings.

According to the above combustor, if a discharge opening is formed towards the inside with respect to an axial direction so as to have a large swirling angle taking into account envelopes, the cooling water is discharged in an inward direction at first and then changes to an outward. Accordingly, by changing combinations of the axial directions, swirling angles, etc., of the discharge openings, it becomes possible to design the discharging directions of cooling water so as to be suitable for a particular system used.

In yet another aspect of the invention, the combustor further includes: a water discharging device which discharges cooling water toward the outside surfaces of the combustor, the water discharging device being disposed at the outside of the combustor.

According to the above combustor, since the water discharging device which discharges cooling water toward outside surfaces of the combustor is provided, the temperature of gas and that of the surfaces of the heat chamber may be decreased and the output of the turbine may be increased.

In yet another aspect of the invention, a part of the water discharged from the water discharging device is mixed in air used for cooling the surfaces of the heat chamber, and a part of the water discharged from the water discharging device is mixed with air used for combustion so that the temperature of gas and that of the surfaces of the heat chamber may be decreased.

According to the above combustor, since a part of the water discharged from the water discharging device is mixed with the air used for cooling the surfaces of the heat chamber, and a part of the water discharged from the water discharging device is mixed with the air used for combustion, the temperature of gas and that of the surfaces of the heat chamber may be decreased, and hence, the output of the turbine may be increased.

In yet another aspect of the invention, the water discharging device discharges water into air used for combustion so that the water is vaporized in the air to decrease the temperature of gas, and a part of the water which is not vaporized flows along a swirling air flow to be adheres to surfaces of the combustor to decrease the temperature thereof.

According to the above combustor, the water discharged from the water discharging device is used for combustion so that the water is vaporized in the air to decrease the temperature of the gas. Also, a part of the water which is not vaporized flows along the swirling air flow and attached to the surfaces of the combustor to decrease the temperature thereof. In this manner, the temperature of gas and that of the surfaces of the heat chamber are decreased and the output of the turbine may be increased. Accordingly, it becomes possible to prevent reliably the heat from damaging the heat chamber due to an increase in the combustion temperature even if an amount of fuel is increased in order to increase the output of the system.

In yet another aspect of the invention, the combustor is an oil firing combustor.

The structure of a combustor explained above is suitable, particularly, for an oil firing combustor whose temperature at the downstream side of the heat chamber tends to be increased, if cooling water is simply sprayed into the combustion chamber, due to the difference in the vaporization speed between the fuel and the cooling water.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of particular preferred embodiments, set out below to enable one to build and use particular implementations of the invention, is not intended to limit the enumerated claims, but to serve as particular examples thereof.

Note that in the following figures, elements which are the same as the ones described in the prior art are enumerated using the same numerals and the explanation thereof is omitted.

Figure 1:
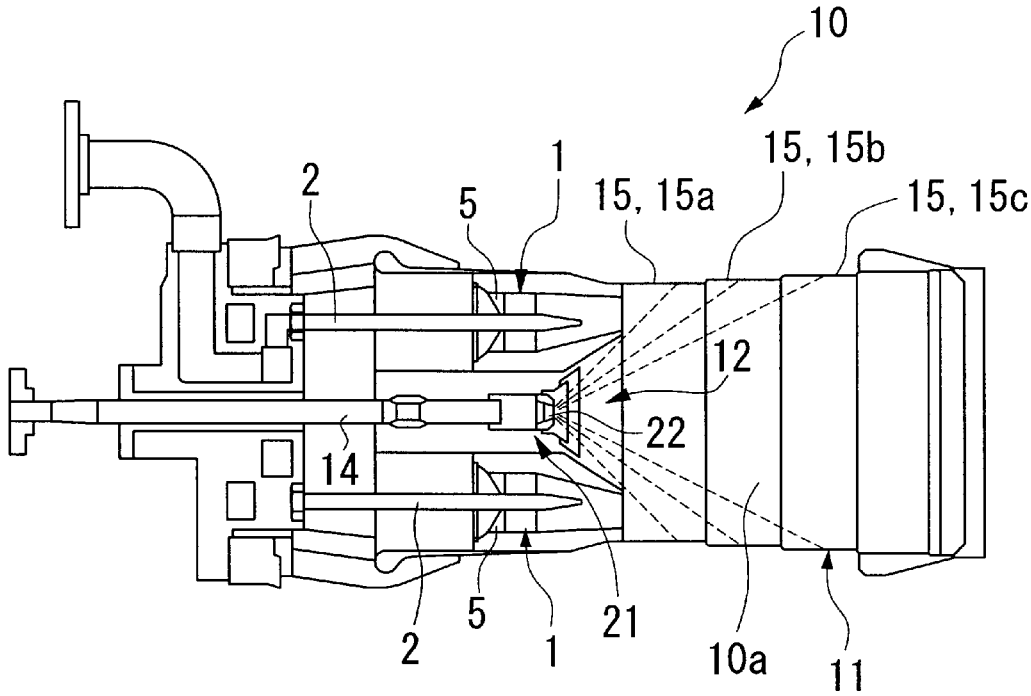
FIG. 1 is a diagram showing a schematic cross-sectional view of a combustor according to an embodiment of the present invention for explaining a structure and elements thereof.

In FIG. 1, the numeral 21 indicates a pilot burner having a cooling water discharging function. In the pilot burner 21, cooling water is discharged from a pilot fuel nozzle 22 which is disposed at the end portion of the pilot burner 21 at the same time fuel is discharged.

Next, a structure of the pilot fuel nozzle 22 will be described in detail.

Figure 2:
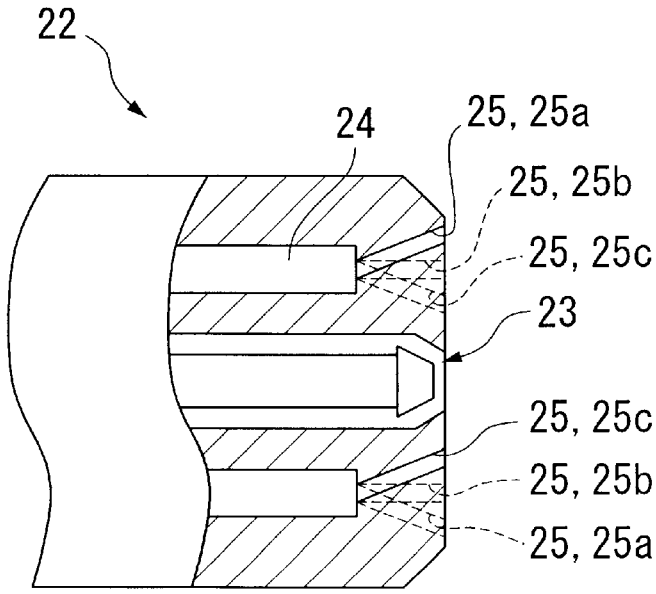
FIG. 2 is a diagram showing a cross-sectional view of a pilot fuel nozzle provided with the combustor according to the embodiment of the present invention for explaining the structure thereof.
Figure 3:
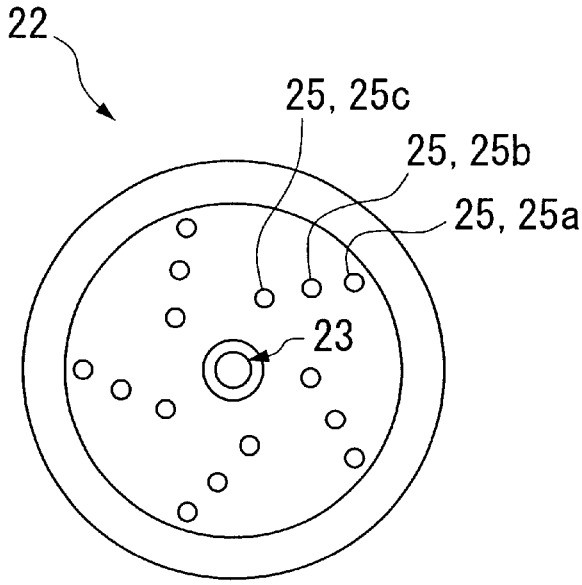
FIG. 3 is a diagram showing a front view of the pilot fuel nozzle provided with the combustor according to the embodiment of the present invention for explaining the structure thereof.

As shown in FIGS. 2 and 3, a fuel discharge outlet 23 is formed at the center of the pilot fuel nozzle 22 so that the fuel is discharged from the fuel discharge outlet 23.

An annular flow path 24 is formed around the fuel discharge outlet 23 of the pilot fuel nozzle 22, and cooling water is transferred to the annular flow path 24 via a supply passage which is not shown in the figure.

Also, a plurality of discharge openings 25 which communicate with the annular flow path 24 are formed at the end face of the pilot fuel nozzle 22 so that the cooling water introduced into the annular flow path 24 is discharged from the discharge openings 25.

In this embodiment, the discharge openings 25 include outer circumferential discharge openings 25*a*, central discharge openings 25*b*, and inner circumferential discharge openings 25*c*. The outer circumferential discharge openings 25*a* are formed toward the peripheral portion of the pilot fuel nozzle 22. The central discharge openings 25*b* are formed along the axial direction of the nozzle 22, and the inner circumferential discharge openings 25*c* are formed toward the center of the nozzle 22.

Next, an explanation is made for discharging cooling water from the discharge openings 25.

When cooling water is introduced in a state where the fuel is discharged from the discharge outlet 23 at the center of the nozzle 22, the cooling water is discharged from each of the discharge openings 25 into the combustion chamber 10*a*.

Figure 4:
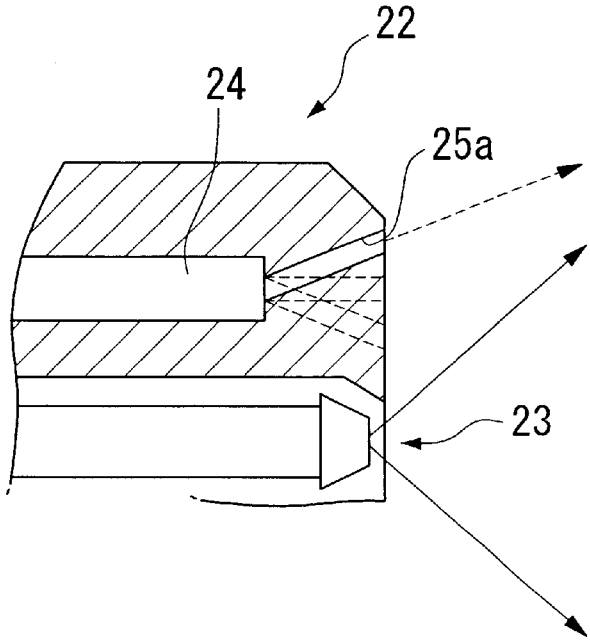
FIG. 4 is a diagram showing a partial cross-sectional view of the pilot fuel nozzle provided with the combustor according to the embodiment of the present invention for explaining directions of cooling water discharged from the nozzle.

As shown in FIG. 4, the cooling water discharged from the outer circumferential discharge openings 25*a* is not affected by the fuel discharged from the discharge outlet 23, and reaches a position at the inside of the combustion chamber 10*a* further away from the pilot burner 21 and the main burner 1.

Figure 5:
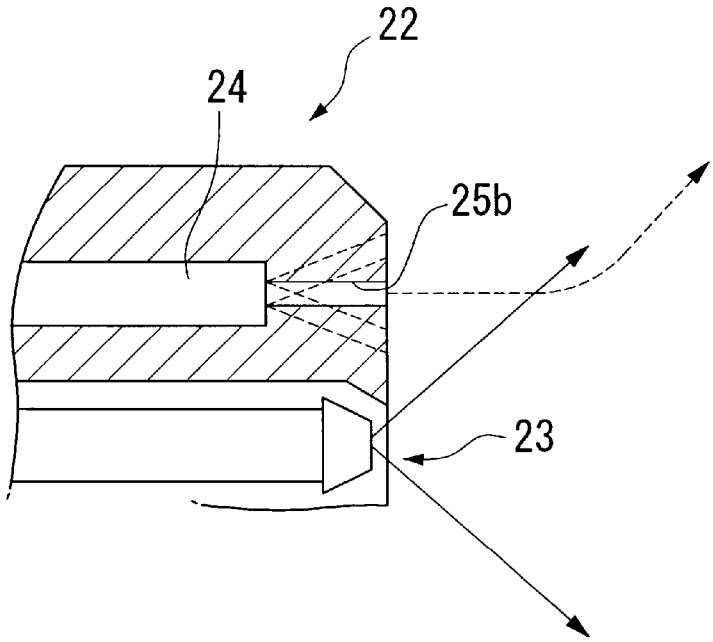
FIG. 5 is a diagram also showing a partial cross-sectional view of the pilot fuel nozzle provided with the combustor according to the embodiment of the present invention for explaining directions of cooling water discharged from the nozzle.

Also, as shown in FIG. 5, the cooling water discharged from the central discharge openings 25*b* is slightly affected by the fuel discharged from the discharge outlet 23 and the course of the cooling water is curved toward the periphery of the nozzle 22. Accordingly, the cooling water reaches a position at the inside of the combustion chamber 10*a* closer to the pilot burner 21 and the main burner 1, as compared with the position of cooling water discharged from the outer circumferential discharge opening 25*a*.

Figure 6:
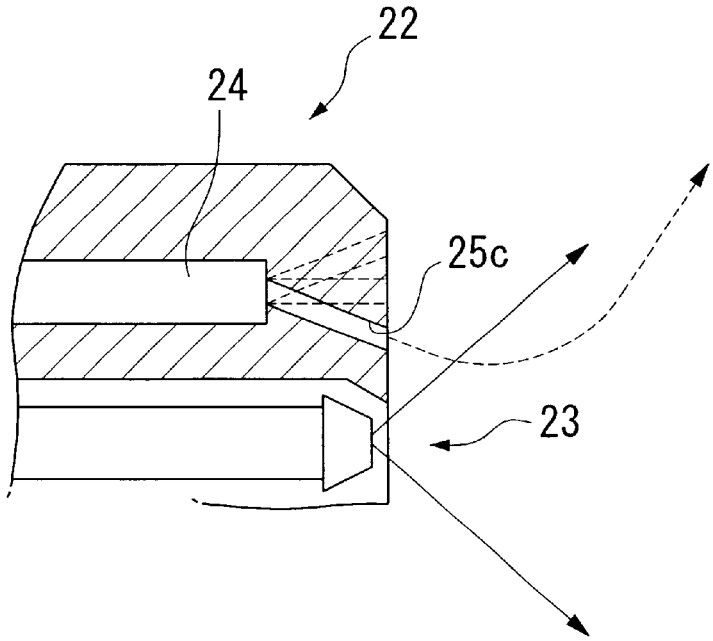
FIG. 6 is a diagram also showing a partial cross-sectional view of the pilot fuel nozzle provided with the combustor according to the embodiment of the present invention for explaining directions of cooling water discharged from the nozzle.

Moreover, as shown in FIG. 6, the cooling water discharged from the inner circumferential discharge openings 25*c* is most affected by the fuel discharged from the discharge outlet 23 and the course of the cooling water curves strongly toward the periphery of the nozzle 22. Accordingly, the cooling water reaches a position at the inside of the combustion chamber 10*a* closest to the pilot burner 21 and the main burner 1.

In this manner, it becomes possible to thoroughly spray the cooling water discharged from each of the discharge openings 25 directly onto the first ring 15*a*, the second ring 15*b*, and the third ring 15*c* forming the heat chamber 11 shown in FIG. 1.

Note that although the directions of cooling water discharged from the discharge openings 25 are varied by providing three different types of discharge openings, namely, the outer circumferential discharge openings 25*a*, the central discharge openings 25*b*, and the inner circumferential discharge openings 25*c* in the above embodiment, it is possible to change the discharging directions of cooling water by using swirling angles of the discharge openings 25.

For example, if a discharge opening is formed towards inside with respect to an axial direction so as to have a large swirling angle taking into account envelopes, the cooling water is discharged in an inward direction at first and then changes to an outward direction. Accordingly, by changing combinations of the axial directions, swirling angles, etc., of the discharge openings, it becomes possible to design the discharging directions of cooling water so as to be suitable for a particular system used.

As explained above, according to the combustor 10 including the pilot fuel nozzle 22 having the above-mentioned structure, it becomes possible to cool down the heat chamber 11 reliably by spraying the cooling water onto the inside surfaces of the heat chamber 11 from the discharge openings 25 which are provided around the fuel discharge outlet 23 disposed at the center of the pilot fuel nozzle 22 of the pilot burner 21.

Next, another embodiment according to the present invention will be explained with reference to FIGS. 7 through 9.

Figure 7:
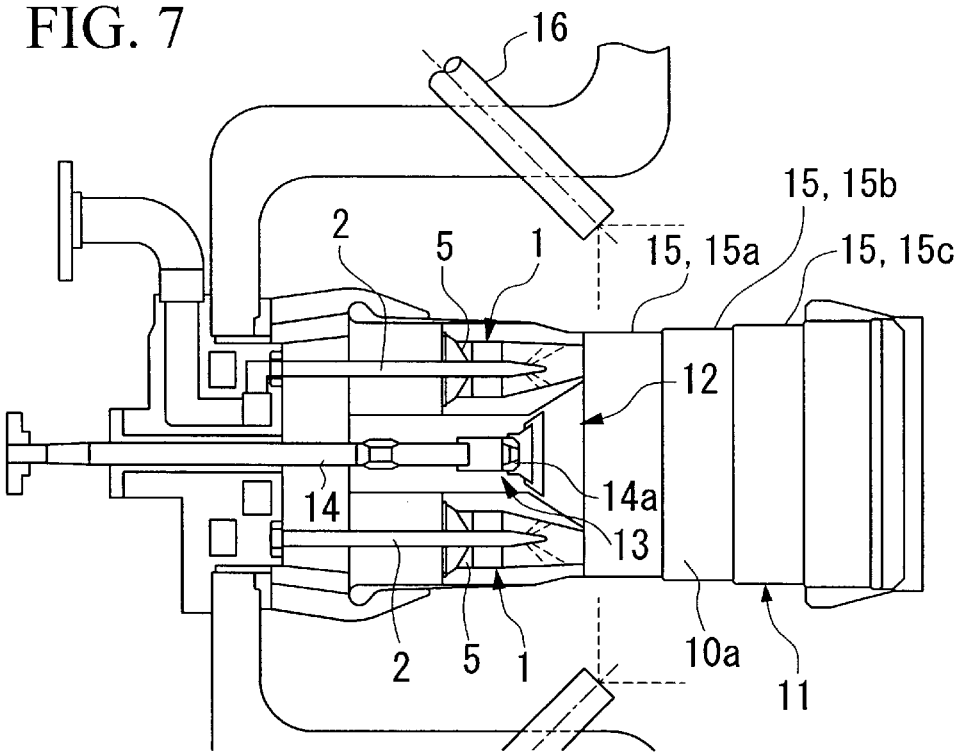
FIG. 7 is a diagram showing a schematic cross-sectional view of a combustor according to another embodiment of the present invention provided with a water discharging device.

In FIG. 7, the combustor is provided with a water discharging device 16. The water discharging device 16 is disposed at the outside of the combustor and discharges water toward the outside surface of the combustor. Also, a part of the water discharged from the water discharging device 16 is mixed in air used for cooling the surfaces of the heat chamber 11. Moreover, a part of the water discharged from the water discharging device 16 is mixed with air used for combustion. In this manner, the temperature of gas and that of the surfaces of the heat chamber 11 are decreased and the output of the turbine may be increased.

Figure 8:
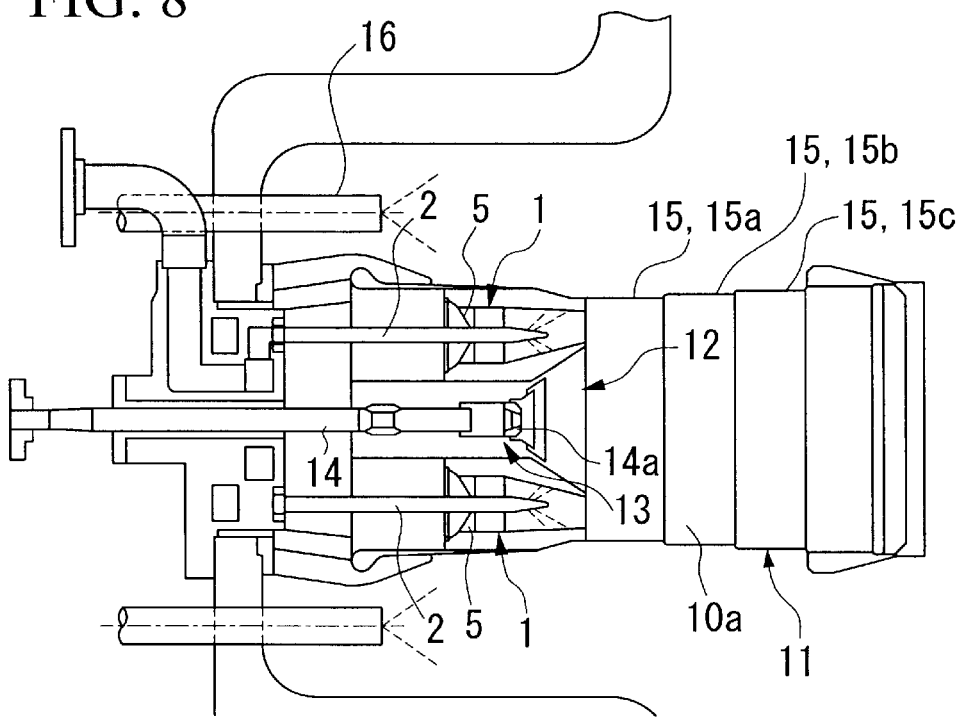
FIG. 8 is a diagram showing a schematic cross-sectional view of a combustor according to yet another embodiment of the present invention provided with the water discharging device.
Figure 9:
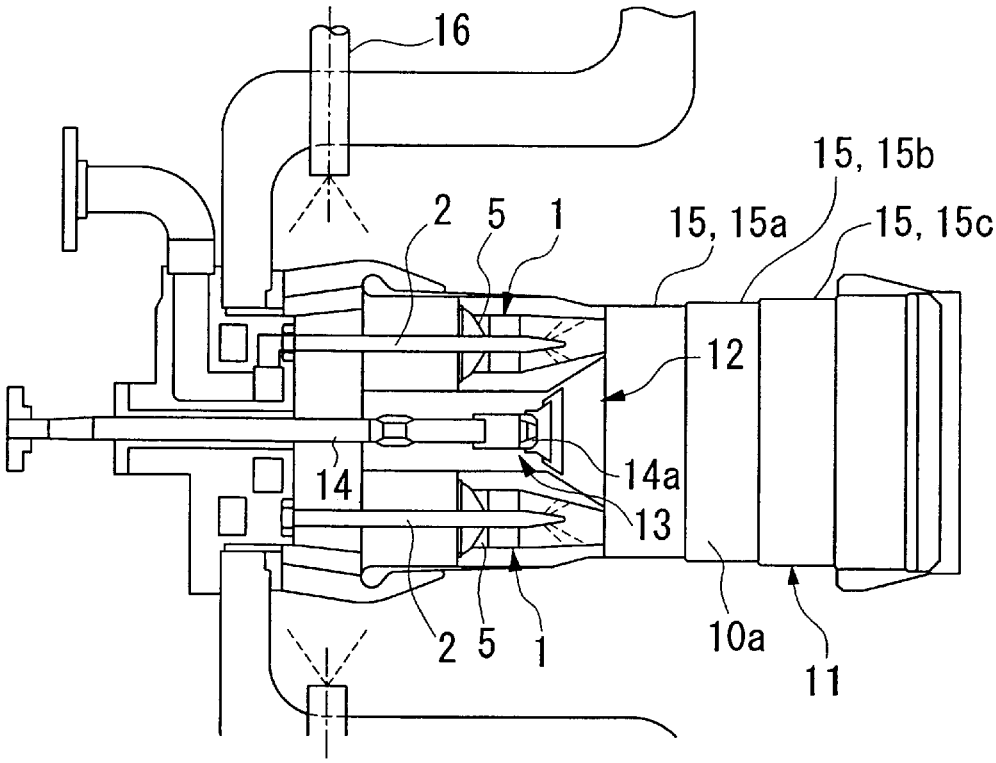
FIG. 9 is a diagram showing a schematic cross-sectional view of a combustor according to yet another embodiment of the present invention provided with the water discharging device.
Figure 10:
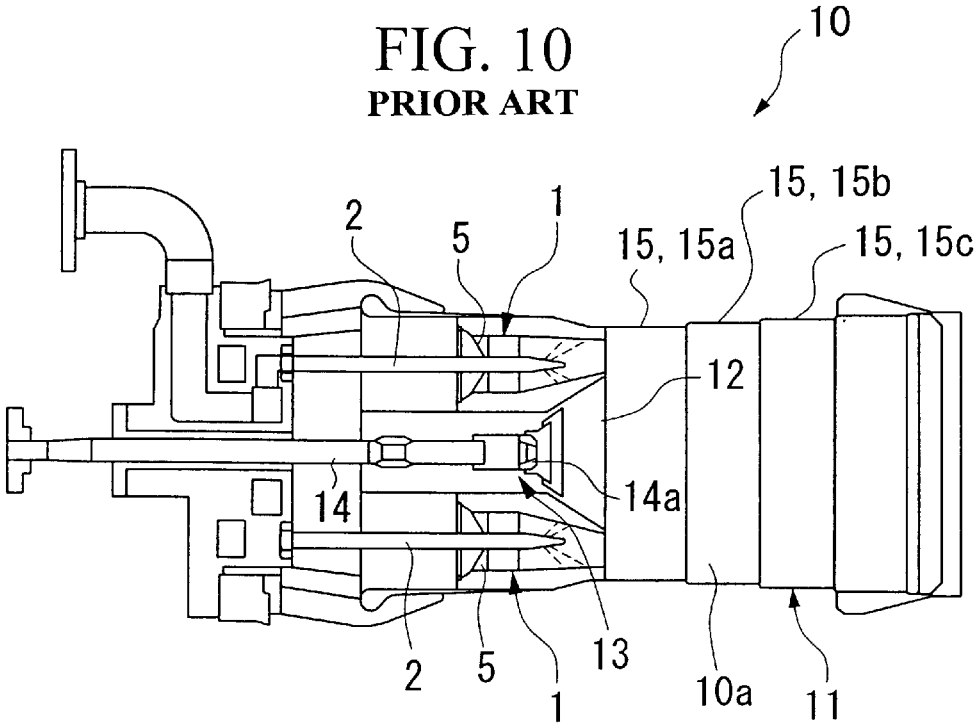
FIG. 10 PRIOR ART
FIG. 10 is a diagram showing a schematic cross-sectional view of a conventional combustor for explaining a structure and elements thereof.

In FIGS. 8 and 9, the water discharging device 16 discharges water into air used for combustion so that the water is vaporized in the air to decrease the temperature of the gas. Also, a part of the water which is not vaporized flows along the swirling air flow and adheres to the surfaces of the combustor to decrease the temperature thereof. In this manner, the temperature of gas and that of the surfaces of the heat chamber 11 are decreased and the output of the turbine may be increased.

Accordingly, it becomes possible to prevent reliably heat from damaging the heat chamber 11 due to an increase in the combustion temperature even if an amount of fuel is increased in order to increase the output of the system. Thus, the structures explained above are suitable, particularly, for the oil firing combustor 10 whose temperature at the downstream side of the heat chamber 11 tends to be increased, if cooling water is simply sprayed into the combustion chamber 10, due to the difference in the vaporization speed between the fuel and the cooling water.

Also, since the direction of the discharge openings 25 differs in the radial direction in accordance with the needs, the cooling water discharged from each of the discharge openings 25 can be directed to various places of the inside surfaces of the heat chamber 11. Accordingly, it becomes possible to cool down the heat chamber 11 thoroughly.

More specifically, as mentioned above, since the discharge openings 25 include the outer circumferential discharge openings 25*a* which are formed toward the peripheral portion of the pilot fuel nozzle 22, the central discharge openings 25*b* which are formed along the axial direction of the nozzle 22, and the inner circumferential discharge openings 25*c* which are formed toward the inside of the nozzle 22, the cooling water discharged from the outer circumferential discharge opening 25*a* is not affected by the fuel discharged from the discharge outlet 23 at the center of the pilot fuel nozzle 22 of the pilot burner 21 and reaches positions at the inside of the combustion chamber 10*a* further away from the pilot burner 21 and the main burner 1, the cooling water discharged from the central discharge opening 25*b* is more or less affected by the fuel discharged from the discharge outlet 23 and the course of the, cooling water curves toward the periphery of the nozzle 22 so that the cooling water reaches positions at the inside of the combustion chamber 10*a* closer to the pilot burner 21 and the main burner 1, and the cooling water discharged from the inner circumferential discharge opening 25*c* is most affected by the fuel discharged from the discharge outlet 23 and reaches positions at the inside of the combustion chamber 10*a* closest to the pilot burner 21 and the main burner 1. Accordingly, it becomes possible to spray the cooling water, which is discharged from the discharge openings 25, thoroughly onto the inside surfaces of the heat chamber 11 so that the heat damaging the heat chamber 11 may be reliably prevented.

As explained above, according to the present invention, the following effects may be obtained.

According to a first aspect of the invention, since the cooling water is discharged from the discharge openings disposed around the fuel discharge outlet which is formed at the center of the nozzle and the cooling water is sprayed onto the inside surfaces of the heat chamber, it becomes possible to reliably cool down the heat chamber. For this reason, the heat damaging the heat chamber due to an increase in the combustion temperature may be reliably prevented even if an amount of fuel supplied is increased in order to increase the output of a turbine. Accordingly, this technique is suitable applied to an oil firing combustor whose temperature at the downstream side of the heat chamber is easily increased if cooling water is simply sprayed into the combustion chamber due the difference in the vaporization rate between the fuel and the cooling water.

According to another aspect of the invention, since the directions of the cooling water discharged from the discharge openings differ in the radial direction, the cooling water may be directed to various places in the axial direction of the inside surfaces of the heat chamber. Accordingly, it becomes possible to thoroughly cool down the heat chamber.

According to yet another aspect of the invention, since the discharge openings include the outer circumferential discharge openings which are formed toward the peripheral portion of the nozzle, the central discharge openings which are formed along the axial direction of the nozzle, and the inner circumferential discharge openings which are formed toward the inside of the nozzle, the cooling water discharged from the outer circumferential discharge opening is not affected by the fuel discharged from the discharge outlet at the center of the nozzle of the burner and reaches positions at the inside of the combustion chamber further away from the burner, the cooling water discharged from the central discharge opening is more or less affected by the fuel discharged from the discharge outlet and the course of the cooling water is curved toward the periphery of the nozzle so that the cooling water reaches positions at the inside of the combustion chamber closer to the burner, and the cooling water discharged from the inner circumferential discharge opening is most affected by the fuel discharged from the discharge outlet and reaches positions at the inside of the combustion chamber closest to the burner. Accordingly, it becomes possible to thoroughly spray the cooling water, which is discharged from the discharge openings, onto the inside surfaces of the heat chamber so that damage given to the heat chamber by heat may be reliably prevented.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A combustor comprising:

a burner; and a combustion chamber including a heat chamber to which fuel is supplied from said burner, wherein said burner includes a nozzle having a fuel discharge outlet formed at the center of said nozzle, from which the fuel is discharged into said combustion chamber, and an annular flow path formed around said fuel discharge outlet through which cooling water is supplied;

said annular flow path communicates with a plurality of discharge openings so that the cooling water is discharged toward inside surfaces of said heat chamber; and said plurality of discharge openings are disposed so that the directions of the cooling water discharged from said discharge openings differ in the radial direction of said nozzle.

2. A combustor comprising:

a burner; and a combustion chamber including a heat chamber to which fuel is supplied from said burner, wherein said burner includes a nozzle having a fuel discharge outlet formed at the center of said nozzle, from which the fuel is discharged into said combustion chamber, and an annular flow path formed around said fuel discharge outlet through which cooling water is supplied;

said annular flow path communicates with a plurality of discharge openings so that the cooling water is discharged toward inside surfaces of said heat chamber;

said plurality of discharge openings are disposed so that the directions of the cooling water discharged from said discharge openings differ in the radial direction of said nozzle; and said plurality of discharge openings comprises an outer discharge opening which is formed toward the peripheral portion of said nozzle, an inner discharge opening which is formed toward the center of said nozzle, and a central discharge opening which is formed between said outer discharge opening and said inner discharge opening.

3. A combustor comprising:

a combustion chamber including a heat chamber; and a burner including a fuel nozzle having a fuel discharge outlet positioned to discharge fuel into the heat chamber and a plurality of discharge openings positioned around the fuel discharge outlet, said plurality of discharge openings being directed to directions different in the radial direction with respect to a longitudinal axis of said fuel nozzle.

* * * * *